US005214817A

United States Patent [19]

Allen

[11] Patent Number: 5,214,817

[45] Date of Patent: Jun. 1, 1993

[54] MODULAR RAMP AND LANDING WALKWAY ASSEMBLY

[76] Inventor: James E. Allen, 2 Woodland Ave., Beverly, Mass. 01915

[21] Appl. No.: 719,998

[22] Filed: Jun. 24, 1991

[51] Int. Cl.[5] ..... E01D 15/10; E01D 19/10

[52] U.S. Cl. ..... 14/69.5; 14/78

[58] Field of Search ..... 404/69.5, 78; 52/299, 52/263, 126.4, 126.5, 127.2, 185

[56] References Cited

U.S. PATENT DOCUMENTS

| | | | |
|---|---|---|---|
| Re. 33,220 | 5/1990 | Collier | 52/126.4 X |
| 3,081,601 | 3/1963 | Fentiman | 14/69.5 X |
| 3,712,187 | 1/1973 | Stelling | 94/4 |
| 3,999,397 | 12/1976 | Albery | 61/48 |
| 4,260,293 | 4/1981 | Peterson | 52/263 X |
| 4,445,802 | 5/1984 | Loov | 404/40 |
| 4,517,698 | 5/1985 | Lamp'l et al. | 14/69.5 X |
| 4,807,317 | 2/1989 | Quinn et al. | 14/69.5 |
| 4,823,529 | 4/1989 | Canfield et al. | 52/263 |
| 4,914,880 | 4/1990 | Albertini | 52/126.4 X |
| 4,942,708 | 7/1990 | Krumholz et al. | 52/263 |

*Primary Examiner*—Ramon S. Britts
*Assistant Examiner*—Nancy P. Connolly
*Attorney, Agent, or Firm*—Don Halgren

[57] ABSTRACT

A modular ramp and landing assembly made from a plurality of similarly sized pre-manufactured concrete filled rectangular panels. The ramp portion is made from the modular panels attached by their shorter sides. A support post with an angularly arranged bracket is placed beneath the corners of adjacent panels to secure them together as well as support them. The landing or horizontal portion of this assembly comprises a similarly sized rectangular panel the long side of which is in abutting relationship with the short side of the end of the ramp. Fastener receivers are equi spaced in duplicate patterns from each corner through the bottom edge of each panel. The size of the panels and the spacing of the fastener receivers are such that minimum support legs and brackets may be utilized in constructing this assembly at a final site.

17 Claims, 4 Drawing Sheets

MODULAR RAMP AND LANDING WALKWAY ASSEMBLY

BACKGROUND OF THE INVENTION

1. Field of the Invention

This invention relates to modular ramps, and more particularly to a walkway ramp assembly which is fabricated in sections at one site and assembled with minimal effort at its final site.

2. Prior Art

Ramps are becoming increasingly common, due primarily to governmental requirements to access of building sites by handicapped people and the like. Ramps assist those people confined to wheelchairs or who use walkers, by providing access to public transportation, to public and private buildings and stores. Each ramp site may be generally different from other ramp sites. Ramps, therefore, should be adaptable and designed to minimize the cost and involvement in initial fabrication and final at-site assembly.

Prefabrication of walkways is not necessarily new, as it may be seen in U.S. Pat. No. 4,445,802 to Loov. This patent shows a series of concrete elements which may have an arcuate turn or a curb side arrangement thereon to develop a concrete walking path. A further prefabricated assembly is shown in U.S. Pat. No. 3,712,187 to Stelling. This patent shows a series of concrete panels which are supported by service modules which have access bores there through. The panels of this prefabricated system, however, are not solid and are, therefore, somewhat more expensive to construct.

A yet further modular ramp is shown in U.S. Pat. No. 4,807,317 to Quinn et al, wherein P.V.C. plumbing components are utilized as leg assemblies supporting via a framework, a plurality of wooden frame panels. The disadvantages of such a system are obvious to those who may have ever walked along a boardwalk. Grooves, nails and splinters of the like could certainly be a hinderance to any handicapped traveler thereon.

It is an object of the present invention to provide a modular sidewalk ramp assembly, which is easily manufacturable at a simple factory and which is easily assemblable and modifiable at an assembly site.

It is yet a further object of the present invention to provide a ramp assembly whose panel components are all of a duplicate rectangular configuration and all of which panels may be of the same dimension.

It is still yet a further object of the present invention to provide a securement system so that those individual panels might be secured to one another in a fail safe manner independent of the longitudinal axis of that particular panel.

BRIEF SUMMARY OF THE INVENTION

The present invention relates to an inclined modular sidewalk ramp assembly which is arranged to be constructed off-site in sections, then taken to construction site for final assembly, and easily adapted to the peculiar terrain and irregularities at that site. This invention comprises a modular ramp, all tread surfaces of which are premanufactured rectangular panels, with the long side of each rectangular member just slightly longer than the width so as to permit a unique fastening arrangement between adjacent panels of the ramp, including its landing portion. The corners of the modular rectangles are called apexes. On inclined portions of this assembly, the long side of the rectangular modular panels extend parallel to the incline direction of the ramp portion.

Adjacent inclined ramp sections share an adjustable support leg, at the juncture of their apexes or corners. The inclined portion of each ramp is defined by the long axis of each section disposed parallel to the long axis of the ramp. The horizontal platform portion or landing section of each ramp assembly has their long axis perpendicular to the long axis of the inclined sections. Each modular panel is defined by an outer peripheral frame of "L" shaped cross section. The frame has a spaced arranged of holes, to which fasteners are welded so as to permit the adjustable support legs to be secured to all ramp sections, whether on an incline or horizontally disposed with their longitudinal axis 90 degrees to the longitudinal axis of the incline sections, without any further holes being drilled, or difficult construction taking place at the assembly site.

The support posts are initially about 60 inches long. Each support post adapted to support the inclined portion of the ramp by a transverse support brace welded across the post at an angle of 10 degrees with respect to the normal from the longitudinal axis of the support post. This angled relationship of each brace permits alignment with the Federally mandated slope of the inclined portions of the ramp, which slope presently is 1 inch rise for a 12 inch run.

The bottom end of the support posts are open, so as to receive a mateable stud which extends off from the middle a foot pad. Inasmuch as the total length of each support post is about 60 inches at the factory where the individual panels and posts are constructed, some of the posts' lower portion, that segment beneath the transverse braces, will be simply cut at the assembly site, to accommodate any variations in elevation, for the ramp to comport with the Federal slope requirements. The foot pad and its stud extending therefrom, mate with the opening on the end of a long support post, or the opening on the end of a short support post, according to local conditions.

The generally transverse support braces are comprised of "L"-shaped brackets having pre-drilled openings, to permit alignment with the pre-arranged openings in the "L"-shaped perimeter frame of contiguous panels, when they are placed adjacent one another to form the ramp.

The inclined ramp panels are attachable, commonly at their upper end, to the horizontally disposed landing panels. Critically, the inclined ramp panels and the landing panels are alike in size and in their bolt-hole configurations. The support posts for the landing panels differ from the ramp support posts only in that their support braces are normal to the longitudinal axis of the support posts, and are not angled as are the support braces on the inclined panel support posts.

The spaced apart openings in the side of the peripheral frame are arranged so as to receive the lower transverse brace of a railing post, whose brace is similarly angled with respect to the longitudinal axis of that railing post, vis-a-vis, the support post.

Each modular section is comprised of a rectangular panel 4 and ½ feet wide and 5 feet long, having an outer peripheral frame of "L"-shape in cross-section. Each corner of each panel comprises a welded junction of "L"-shaped members comprising the frame. Each corner defines an apex and may have a plurality of spaced openings arranged a particular distance on the outer side of the "L"-shaped frame member, from that apex.

Critically, an arrangement of at least three spaced openings are also arranged a particular distance on the lower peripheral side of the "L"-shaped frame member from that apex. The openings, for example, on the lower side of each frame member are 3⅝ inches, 7¼ inches and 10¼ inches from each apex.

A fastener receiver or threaded ferrule is secured to the openings on both the outer side and lower side of the frame members. The threaded ferrule has a distal end which is closed off. Reinforcing rods are arranged across opposed frame portions. The volume within the frame members is filled with concrete, having a lower planar surface even with the bottom side of the lower edge of the frame members, and an upper planar surface even with the upper edge of the outer side frame portions beneath the inclined ramp panels.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
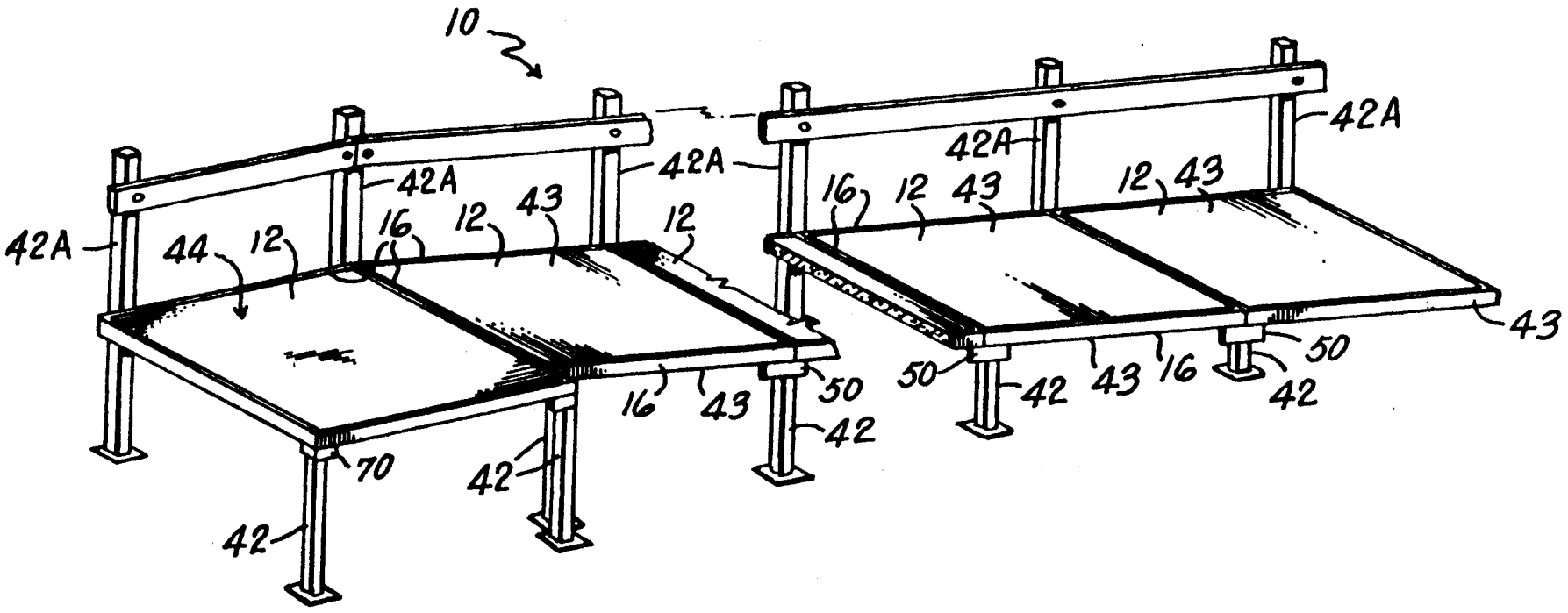
FIG. 1 is a perspective view of a ramp and landing assembly after its final construction at a site.

Referring now to the drawings in detail and particularly to FIG. 1, there is shown an inclined modular ramp assembly 10, which has been assembled from a plurality of similar rectangular panels 12 and an arrangement of support posts 14.

Figure 2:
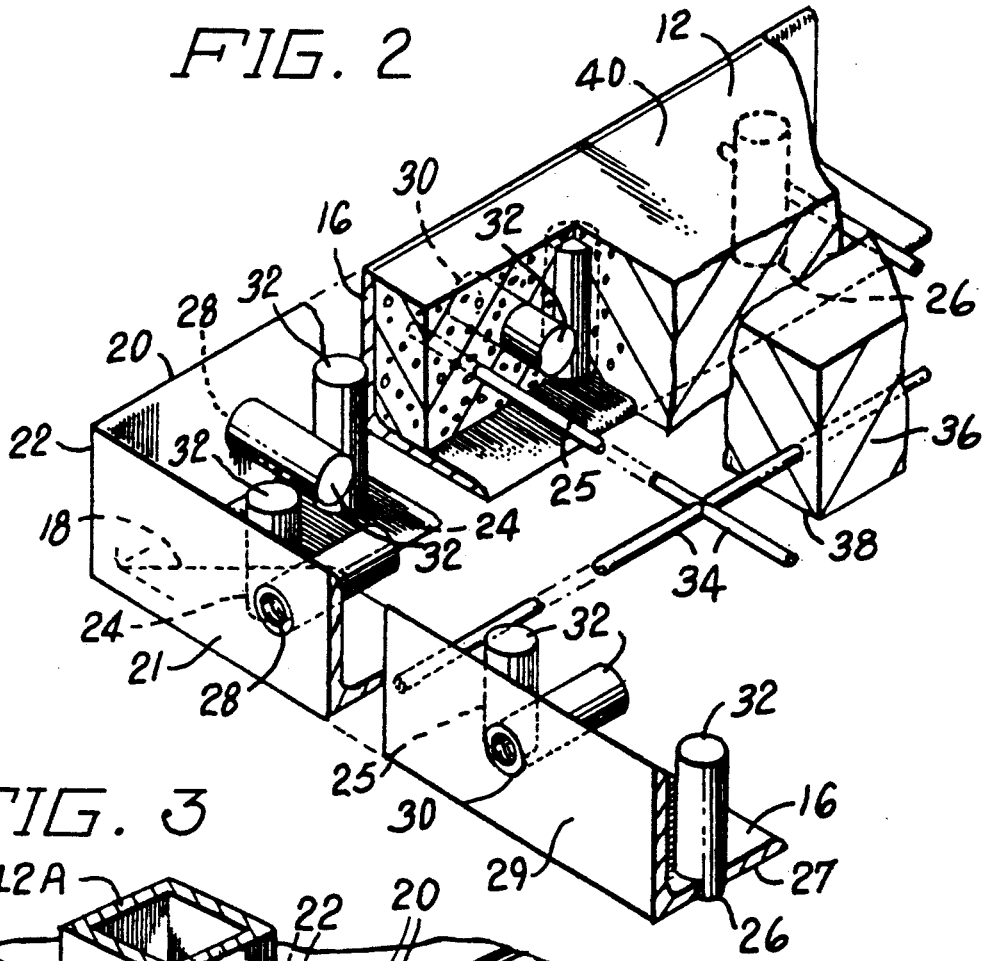
FIG. 2 is a perspective view of a ramp or landing panel showing only a corner portion thereof, portions shown cut-away for clarity.

Each panel 12 or modular section is of rectangular configuration, and for purposes of our description, each panel 12 of this assembly 10, for example, measures 4½ feet wide by 5 feet long. Each panel 12 has an outer peripheral frame 16 of "L"-shape in cross-section, as may be seen in the sectional view of a corner of a panel 12, shown in FIG. 2. The corner of each panel 12 comprises a welded junction 18 of "L"-shaped members 20 and 21 that comprise the peripheral frame 16.

Each corner defines an apex 22 having a pattern of three spaced openings 24, 25 and 26 disposed for example, at about 3⅝ inches, 7¼ inches, and 10⅞ inches respectively from each apex 22, through the bottom side 27 of each "L"-shaped frame member 20 and 21.

A pair of spaced openings 28 and 30 may also be arranged about 3⅝ inches and 7¼ inches from each apex 22 on the outer side 29 of each "L"-shaped frame member 20 and 21.

A fastener receiver or threaded furrule 32 is welded into each spaced opening 24, 25, 26, 28 and 30 on the "L"-shaped frame members 20 and 21. The threaded ferrules 32 have a distal end which may preferably be closed off by a set screw or the like, not shown.

An arrangement of reinforcing rods 34 are arranged across the opposed frame members 20 and 21. The volume within the rectangular periphery of frame members 20 and 21 is filled with concrete 36 (and reinforcing rods 34), the concrete having lower planar surface 38 even with the bottom side of the lower side 27 of the frame members 20 and 21. The concrete 36 has an upper planar (tread) surface 40, even with the upper distalmost peripheral edge of the outer side 25 of the frame members 20 and 21.

Adjacent inclined ramp panels 12 share an adjustable support post 42, at their contiguous apexes 22, as may be seen in FIGS. 1, 3, 4 and 5. The inclined portion of each ramp assembly 10 is defined critically, by the long side 43 of each rectangular panel 12 being parallel and in axial alignment with one another, as shown in FIGS. 1 and 6. A panel 12 comprising a platform or landing section 44 is critically arranged with its long side 46 perpendicular or normal, to the long side 43 of the inclined panels 12. The spaced holes 24, 25 and 26 on the lower side 27 of each "L"-shaped frame member 20 and 21, as aforementioned, are arranged so as to permit the adjustable support legs 42 to be secured at the juncture of contiguous ramp panels 12 and/or to the landing section 44 without further holes being drilled or difficult construction taking place at the ramp assembly site.

Figure 3:
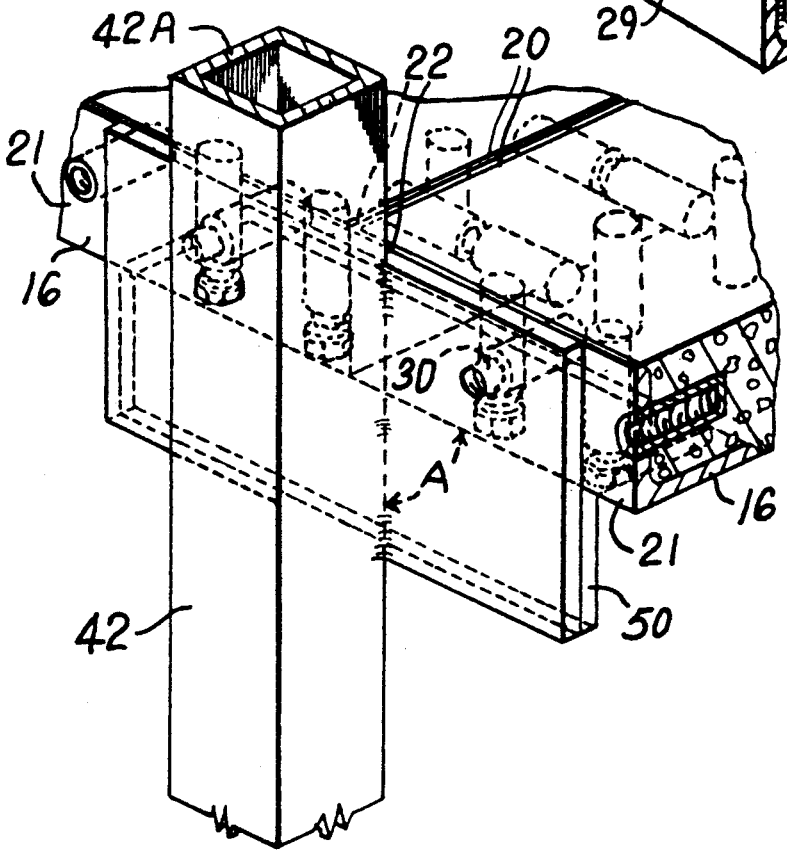
FIG. 3 is a perspective view of portions of two adjacent panels supported by a reinforced brace on a support and rail post.
Figure 4:
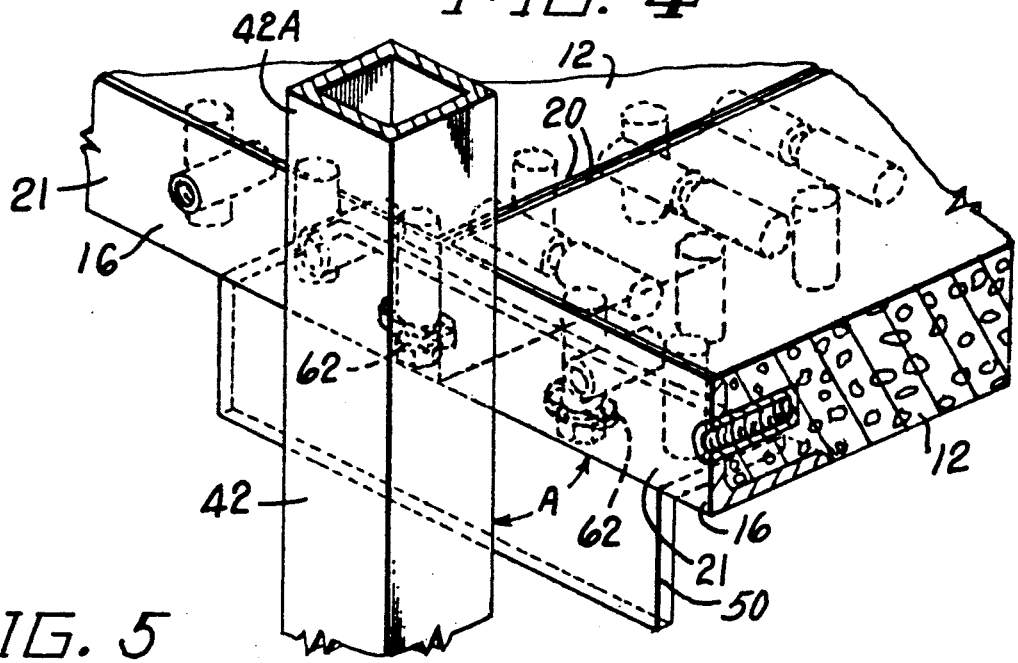
FIG. 4 is a perspective view of portions of two adjacent panels supported by an embodiment of a support and rail post.
Figure 5:
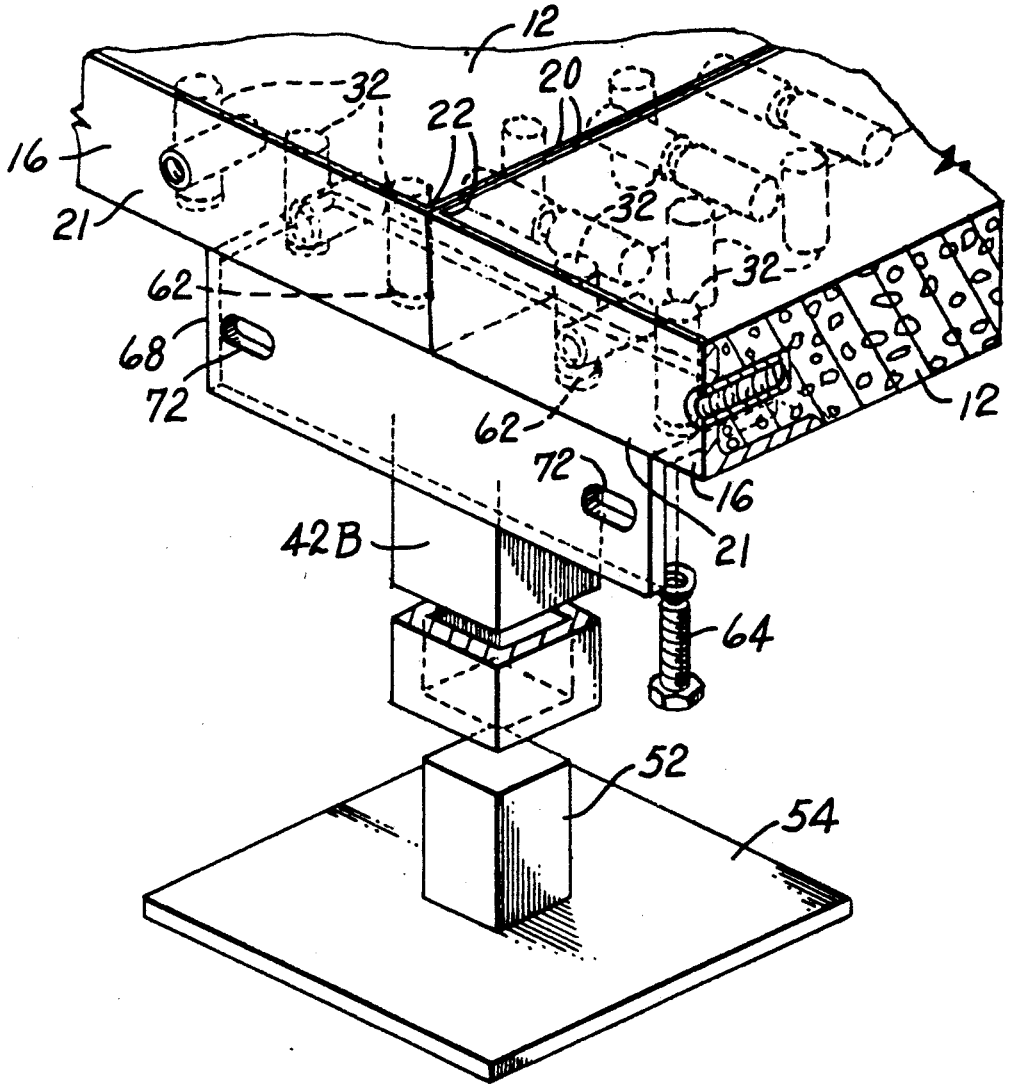
FIG. 5 is a perspective view of portions of two adjacent ramp panels supported by a preferred embodiment of a support post.
Figure 6:
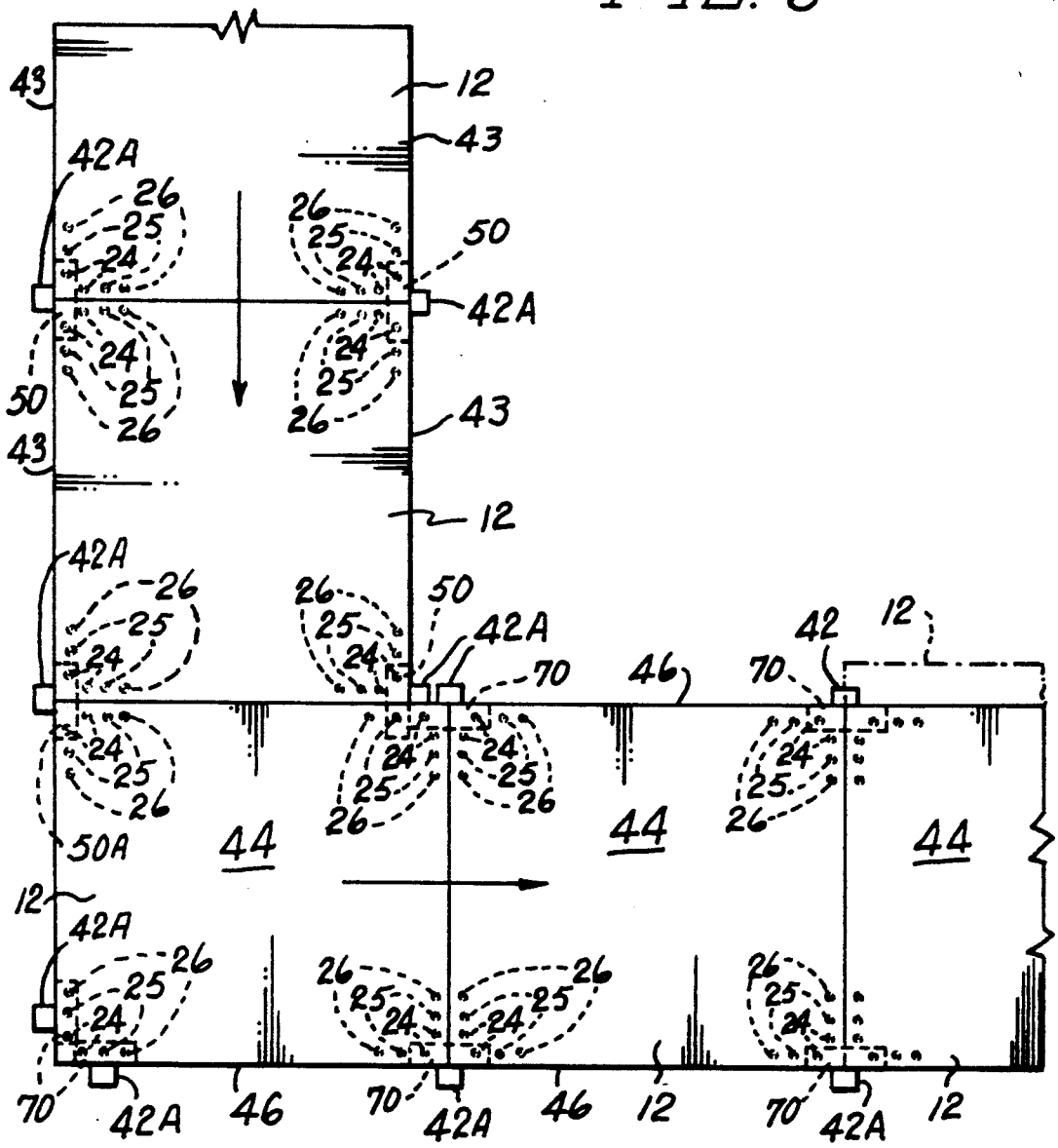
FIG. 6 is a plan of a ramp and landing walkway assembly.

In one preferred embodiment, the entire length of the support post 42A from top to bottom, may be 95½ inches long, the top portion comprising a stanchion for a handrail, the lower portion comprising the "panel" support portion of the post 42 beneath where a transverse brace 50 is secured thereto, as partially shown in FIGS. 3, 4 and 5. The transverse brace 50 welded to each post 42 are adapted to support the inclined panels 12 of the ramp assembly 10, welded at an angle "A" of about 80 degrees, from the longitudinal axis of the inclined ramp support post 42. The angled relationship of each brace 50 permits conformance of the inclined panels 12 with the Federally mandated slope requirements, which slope is 1 inch rise for a 12 inch run.

The support posts 42 are preferably square in cross section, as may be seen in FIGS. 3, 4 and 5, each having a bottom end which is open so as to enable it to receive a mateable stud 52 which extends upwardly from the middle of a foot pad 54, also shown in FIG. 5. Inasmuch as the total length of each inclined ramp support post 42 is uniformly fabricated at the factory, at a length of about 95 inches, some of the posts 42 at the final assembly site will be too long. A lower portion beneath the generally transverse brace 50, will simply be cut at the assembly site, to adapt to transverse brace to the proper vertical height for accommodating the contiguous panels 12, and to allow for variations in the level of terrain at the assembly site.

The generally transverse braces 50 are comprised of "L"-shaped brackets having predrilled holes 62, spaced 3½ inches and 7¼ inches away from the mid-point, and on each side thereof, as may be seen in FIGS. 3, 4 and 5. The predrilled openings permit easy alignment with the predrilled spaced openings 24, 25 and 26 in the lower side 27 of each "L"-shaped frame member 20 and 21, permitting a bolt 64 to mate with the threaded ferrules 32 with minimum effort at the final assembly site.

In a further preferred embodiment, the support posts 42B are disposed beneath the apexes 22, which do not have the extended height for rail support posts, are utilized to carry the contiguous inclined panels 12 and are all initially about 40 inches long and have a transverse brace 68 secured to and extend directly across the uppermost end, as shown in FIG. 5. Each transverse brace 68, comprised of an "L"-shaped bracket has predrilled openings, not shown, throughout its upperside, similar to the aforementioned braces 50, is secured at an angle of about 80 degrees with respect to the longitudinal axis of the support post 42B, so as to permit conformance and supportive alignment of the top surface of the transverse brace 68 with the lower peripheral frame surface 27 of adjacent inclined ramp panels, the predrilled holes being in alignment therebetween, as well. The lower portion of this support post 42, beneath the transverse brace 68 may be cut before installation, to whatever length is necessary, at the assembly site so as to accommodate local terrain beneath the juncture of adjacent inclined ramp panels 12.

The attached inclined ramp panels 12 are securable at their (commonly) highest elevated end, to the horizontally disposed landing portion 44 panels 12. It is critical that the panels 12 comprising the horizontal landing be comprised of rectangular panels the same size and shape as the inclined panels 12. The support posts 42/42A for the landing portion 44 differ only from the support posts for the inclined panels 12 in that their braces 70, are normal to the longitudinal axis of the support posts 42/42A. Support braces 50A bridging a ramp panel and a landing panel are formed to align themselves with the bottom of their respective panels. That is, part of the brace 50A is angled at about 80 degrees with respeat to the longitudinal axis of the post 42/42A and the other half of the brace is perpendicular to the axis of the post 42/42A.

The spaced apart openings 28 and 30 in the outer side 25 of the peripheral frame member 20 and 21 and the openings 72 in the side flange of the brace 68 are arranged so as to be able to receive a lower transverse brace, not shown, of a railing post 42A.

The spaced openings 24, 25, and 26 (the receiver fasteners, not indicated here) are shown in the planar view in FIG. 6. This also indicates that the brace 50 on each post 42/42A for the incline portion need only be attached to the "first" openings 24 of adjacent panels 12. The brace 50A on each post 42/42A bridging the inclined portion and the landing portion, need only be attached to the "first" opening on the incline panel and the "second" or middle opening 25, on its contiguous landing panel, such as shown on the inside corner in FIG. 6. The brace 70 (which is completely perpendicular to the longitudinal axis of the post 42/42A) and which supports the landing panels exclusively, such as shown on the outside corner of the landing portion, are secured to the panels 12 (by the bolts) through the first and third openings 24 and 26 respectively. Two support posts 42/42A are disposed at the outside corner of the horizontal landing.

This critical spacing relationship of the openings (and their receiving fasteners) with respect to the length and width of the panels permits the minimal variations (only three) required in the braces when assembling a walkway. All the panels themselves are exactly alike, thus minimizing the initial cost of building them and assembling them.

A modular ramp is thereby shown for providing access to above or below ground level locations by handicapped persons, said modular ramp being buildable at an off-site construction location for simple attachment together at its final assembly site.

Thus, the invention comprises a plurality of similarly sized rectangularly shaped panels which have long side portions and shorter end portions which meet at four corners, which panels are attachable end portion to end portion to form an inclined ramp; at least one similarly sized rectangularly shaped panel arranged with its longer side portion in abutting relationship to the shorter end portion at the horizontal landing, the inclined panels comprising the ramp; a single support leg arranged at each side of the juncture, of adjacent ramp panels, as shown in FIG. 6, the support legs thereat having an angled brace thereon which is readily securable to each "first" fastener receiver spaced closest to the corner of each long side and short end portion; a single support leg arranged at the end of the inclined ramp supporting the inclined panel at an inside corner thereat by securement of its bracket to a "first" fastener receiver, and to the horizontal panel in the landing, to a "second" fastener on the landing panel; and a pair of support legs arranged at the outside corner of the horizontal panel landing, each of the support legs attached to a "first" and a "third" fastener at the corner of one long side portion and one shorter end portion.

Thus, the invention also includes a modular ramp assembly wherein "first", "second" and "third" fastener receivers are equally spaced from each corner on both the long side portions and the shorter end portions.

The fastener receivers comprise threaded nuts which are welded at the openings which are spaced and disposed through the "L"-shaped angle iron comprising the frames of the modular panels.

The "L"-shaped angle iron is filled with concrete to provide an upper and a lower surface of the modular panels. The frame may have fastener receivers on the sides of the "L"-shaped angle iron as well as on the bottom thereof. The fastener receiver on the sides of the modular panels may have a handrail support post attachable thereto. A bolt secures the brackets to the fastener receivers in the modular panels.

The method by which the invention is made comprises securing a plurality of "L"-shaped frame members together into a rectangular periphery having a pair of parallel long sides and a pair of parallel short sides; securing a plurality of fastener receivers onto the inner side of the bottom of the "L"-shaped frame members, spaced from each corner thereof; filling the "L"-shaped peripheral frame member with concrete to define flat panel members; supporting a plurality of the said flat panel members to form an inclined ramp with their long sides in alignment; supporting at least one flat panel member adjacent the end of the panel members comprising the ramp to form a horizontal landing portion, the landing portion having its long parallel sides perpendicular to the long parallel sides of the panel members of the ramp portion; and attaching the landing panel and the adjacent inclined panel between adjacent dissimilarly positioned fastener receivers.

The method also comprises the steps of attaching a brace onto a support leg at an angle which corresponds to the angle of incline of the incline panel members with the horizontal; arranging a support leg so as to support adjacent inclined panel members and securing each longitudinal side thereof to a common bracket on the support leg; arranging a common support leg to support an inclined panel member and a landing panel member, the leg having a brace attached thereto, one half the length of which is arranged at an angle which corresponds to the angle of incline of the inclined panel members, and the other half the length of which is perpendicular to the leg and parallel to the bottom of the landing panel member which it is to support.

Thus what has been shown in a novel construction of an inclined ramp which permits building of common rectangular ramp panels and common ramp panel support posts which have pre-alignment means to permit minimum assembly time and skill. Common support posts are severable to proper lengths at the assembly site to permit on site adaption to vagaries of terrain. The common ramp panels have three spaced holes on each side and next to each apex which allow the ramp panels to be aligned in one orientation for the incline portion of the assembly, and aligned 90 degrees to that inclined orientation for the horizontal or landing portion of the assembly, the spaced holes permitting a support post to bear an inclined panel contiguously secured to a landing (horizontal) panel with no further on site adaptation necessary.

I claim:

1. A modular ramp construction for establishing an inexpensive pre-manufactured incline portion and horizontal landing portion walkway assembly, comprising:
- a plurality of solid rectangularly shaped panels having a lengthwise side and a widthwise side, the lengthwise side being greater than the widthwise side;
- a corner defining an apex at the intersection of adjacent long and shorter sides;
- at least three fastener receivers arranged in a pattern of openings which pattern is duplicated and equally spaced from each apex on the bottom periphery of each panel;
- a plurality of support members for joining and supporting adjacent panels at their sides thereof;
- said incline portion of said ramp assembly having its lengthwise sides of its panels extending perpendicular to the lengthwise sides of the panels of said landing portion;
- said pattern of fastener receivers on said panels being arranged so as to permit adjacent ramp panels and/or a ramp panel and an adjacent landing panel to be supported by a common support member at each of their junctures, thus permitting a ramp and landing walkway to be assembled on site with a minimum time, effort, skill and components;
- said support members each comprise a vertical post with a transverse brace attached thereto, for securement to panels by said fastener receivers; and
- wherein at least half of said transverse brace is arranged at an acute angle with respect to the longitudinal axis of said support leg.

2. A modular ramp construction for establishing a walkway assembly as recited in claim 1, wherein the periphery of each of said panels is comprised of "L"-shaped frame members.

3. A modular ramp construction for establishing a walkway assembly as recited in claim 2, wherein said "L"-shaped frame members defining the periphery of each panel are filled with concrete to define a walkway surface.

4. A modular ramp construction for establishing a walkway assembly as recited in claim 3, wherein said fastener receivers are attached to the inner side of said "L"-shaped frame members, said fastener receivers also being embedded within said concrete filled therewithin.

5. A modular ramp construction for establishing a walkway as recited in claim 3, wherein at least a first, second and a third fastener receivers are disposed along each frame member in a pattern spaced equally from each apex.

6. A modular ramp construction for establishing a walkway as recited in claim 5 said braces supporting and securing adjacent inclined panels are secured to first fastener receivers on adjacent inclined panels along said lengthwise sides.

7. A modular ramp construction for establishing a walkway as recited in claim 5, wherein said braces supporting and securing the lengthwise side of an inclined panel to the perpendicularly disposed lengthwise side of a horizontal landing panel are secured between first and second fastener receivers respectively.

8. A method of constructing a modular ramp walkway assembly, comprising the steps of;
- securing a plurality of "L"-shaped frame members together into a rectangular periphery having a pair of parallel long sides and a pair of parallel short sides;
- securing a plurality of fastener receivers through the inner side of the bottom of said "L"-shaped frame members, in a pattern, spaced from each corner thereof;
- filling said "L"-shaped peripheral frame member with concrete to define flat solid panel members;
- supporting a plurality of said flat panel members to form an inclined ramp with their long sides in axial alignment;
- supporting at least one flat panel member adjacent the end of said panel members comprising said ramp to form a horizontal landing portion, said landing portion having its long parallel sides perpendicular to said long parallel sides of said panel members of said ramp portion; and
- attaching at least part of said landing panel and said adjacent inclined panel between adjacent dissimilarly positioned fastener receivers.

9. A method of constructing a modular ramp walkway assembly as recited in claim 8, also the steps of:
- attaching a bracket onto a support leg at an angle which corresponds to the angle of incline of the incline panel members with the horizontal;
- arranging a support leg to support adjacent inclined panel members and securing each longitudinal side thereof to a common bracket on said support leg.

10. A method of constructing a modular ramp walkway as recited in claim 9, also including the steps of:
- arranging a common support leg between an inclined panel member and a landing panel member, said leg having a bracket attached thereto, one half the length of which is arranged at an angle which corresponds to the angle of incline of the inclined panel member, and the other half the length of which is perpendicular to the leg and parallel to the bottom of the landing panel member which it is to support.

11. A modular ramp for providing access to above or below ground level locations by handicapped persons, said modular ramp being buildable at an off-site construction location for simple attachment together at its final assembly site, comprising:
- a plurality of similarly sized rectangularly shaped panels which have long side portions and shorter end portions which meet at four corners, which panels are attachable end portion to end portion to form an inclined ramp;

at least one similarly sized rectangularly shaped panel arranged with its longer side portion in abutting relationship to the shorter end portion, at the horizontal landing, of the inclined panels comprising the ramp;

a single support leg arranged at each side of the juncture of adjacent ramp panels, said support legs thereat having an angled bracket thereon which is readily securable to a first fastener receiver spaced from the corner along each long side;

a single support leg arranged at the end of the inclined ramp supporting the inclined panel at an inside corner thereat by securement of its bracket to a first fastener receiver, and to the horizontal panel in the landing, to a second fastener on said landing panel;

a pair of support legs arranged at the outside corner of the horizontal panel landing, each of said support legs attached to a first and a third fastener at the corner of one long side portion and one shorter end portion; said first, second and third fastener receivers are equally spaced from each corner on both the long side portions and the shorter end portions;

an "L"-shaped angle iron comprising the long side portions and short end portions or frames of said modular panels;

said fastener receivers comprising threaded nuts which are welded about openings which are spaced and disposed through the "L"-shaped angle iron comprising the frames of said modular panels; and wherein said "L"-shaped angle iron is filled with concrete to provide an upper and a lower surface of said modular panels.

12. A modular ramp assembly as recited in claim 11, wherein said frame has fastener receivers on the sides of said "L"-shaped angle iron as well as on the bottom thereof.

13. A modular ramp assembly as recited in claim 12, wherein said fastener receiver on the sides of said modular panels have a handrail support post attachable thereto.

14. A modular ramp assembly as recited in claim 12, wherein a bolt secures said brackets to said fastener receivers in said modular panels.

15. A modular ramp assembly as recited in claim 12, wherein said panels are four and one-half feet wide and five feet long.

16. A modular ramp assembly as recited in claim 11, wherein said support legs are hollow and are matable with a base having a standoff which fits into the lower end of said hollow support leg.

17. A modular ramp support as recited in claim 16, wherein said support legs at their lower ends, are adapted to be severable so as to permit various lengths thereof to accommodate any assembly site.

* * * * *